United States Patent [19]

Zahaykevich

[11] 4,168,018

[45] Sep. 18, 1979

[54] DISPENSING AND MIXING DEVICE FOR PLURAL FLUIDS

[76] Inventor: George Zahaykevich, 27 St. Mary's Ct., Brookline, Mass. 02146

[21] Appl. No.: 670,878

[22] Filed: Mar. 26, 1976

[51] Int. Cl.[2] ..... B01F 5/00

[52] U.S. Cl. ..... 222/82; 222/95; 222/136; 222/196; 239/416.4; 239/434.5; 366/138; 366/178; 366/339

[58] Field of Search ..... 222/136, 145, 148, 135, 222/82, 196; 239/417.3, 416.4, 434.5; 366/138, 178, 339

[56] References Cited

U.S. PATENT DOCUMENTS

| | | | |
|---|---|---|---|
| 218,337 | 8/1879 | Thomas | 239/434.5 X |
| 1,590,578 | 6/1926 | Harris et al. | 222/145 |
| 2,530,206 | 11/1950 | Nieburg | 239/434.5 X |
| 2,986,306 | 5/1961 | Cocanour | 222/136 X |
| 3,067,987 | 12/1962 | Ballou et al. | 222/145 X |
| 3,241,722 | 3/1966 | Nissen | 222/145 |
| 3,790,030 | 2/1974 | Ives | 222/145 X |
| 3,843,023 | 10/1974 | Vroom | 222/136 |
| 3,949,904 | 4/1976 | Hendrickson | 222/145 X |

FOREIGN PATENT DOCUMENTS

| | | | |
|---|---|---|---|
| 9115 | of 1910 | United Kingdom | 239/434.5 |
| 107665 | 7/1917 | United Kingdom | 239/417.3 |

*Primary Examiner*—David A. Scherbel
*Assistant Examiner*—Frederick R. Handren
*Attorney, Agent, or Firm*—Wolf, Greenfield & Sacks

[57] ABSTRACT

A multi-component fluent product, such as an epoxy resin mixture, is controllably mixed and dispensed from an improved mixer-dispenser. The device has a pair of pressure chambers each of which receives one of the fluent components in its original package. Air under pressure is communicated to the two chambers to force the fluent materials from their packages into flow passages which merge and cause mixing of the components. Special valve arrangements are provided along the flow passages to control the mixture proportions and to enable the flow passages to be purged of the mixed components when desired.

21 Claims, 16 Drawing Figures

DISPENSING AND MIXING DEVICE FOR PLURAL FLUIDS

This invention relates to dispensers for fluent material such as those which are composed of a plurality of components which must be mixed before use, such as, for example, thermosetting epoxy materials which require mixing of a resin and catalyst. The materials usually must be mixed in precisely controlled proportions and, once mixed, will harden. Although a number of mixing and dispensing devices have been proposed in the prior art, they have not been free from difficulty. One of the primary problems encountered is to keep the flow passages in a clear, unobstructed condition. Failure to do so, particularly when epoxy or other thermosetting materials are employed, can result in the permanent blockage of the flow passages which can ruin the device. With materials which display a strong tendency to adhere to the internal surfaces of the passage, it is quite difficult to effect a complete purging of the catalyst because some of the catalyst tends to adhere to the walls of the full passage. In order to effectively purge such devices to avoid subsequent hardening of the material and resulting blockage, it is necessary to shut off the catalyst flow and then continue flow of the primary resin for a long time to enable the resin material to wipe the internal passage surfaces clean of catalyst and draw all the catalyst from the system. Such prolonged purging is undesirable for a number of reasons including the significant waste of material which necessarily results. These problems are particularly acute with extremely viscous materials such as the type of putty-like materials used in automobile body shops which have a natural tendency to adhere to metal and other surfaces. This makes it quite difficult to completely purge the system of the catalyst.

In addition, it often is important to control accurately the proportions in which the fluent components are mixed. For example, where the material to be dispensed is an epoxy resin composed of resin and catalyst components, the hardening time of the resin is a direct function of the proportions in which the resin and catalyst are mixed. Depending on the intended use for the dispensed, mixed product, control of the setting time may be extremely critical. It is among the primary objects of the invention to provide an improved mixing and dispensing device for use with such fluent multi-component materials.

SUMMARY OF THE INVENTION

The invention includes a plurality of sealable pressure chambers, each one intended to receive one of the fluent components to be mixed and dispensed. Air under pressure is applied to each of the sealed chambers to urge the fluent components through outlet passages which lead from the chambers to a mixing region. In a two-component system of the type described in the illustrative embodiment, the resin and catalyst chambers each have an outlet passagethrough which the individual components may flow. The flow passages join at the mixing region to premix the components. The premixed components then flow through a nozzle which also include a static mixer to finally mix and homogenize the components. A control valve is located along the catalyst flow passage and serves as an on-off and mixture control valve to either open, obstruct or vary the flow rate of the catalyst through its flow passage, and thereby control the proportions in which the resin and catalyst are mixed. The control valve also controls the communications of air under pressure to the pressure chambers. In one extreme position of the control valve, the catalyst is permitted to flow through the valve and air under pressure is simultaneously applied to both the resin and catalyst chambers. In the opposite extreme position of the control valve, the catalyst passage is blocked, the air pressure source is cut off from the chambers and air from the main resin chamber is permitted to bleed into the atmosphere at a controlled rate which permits a gradual reduction of the pressure in that chamber. In this mode of operation, the residual pressure in the main chamber causes continued flow of resin component to purge the portions of the flow passages downstream of the control valve from the mixed components. In one embodiment of the invention which is intended for use with materials in which the proportion of catalyst is relatively small (for example, 3%) the intermediate positions of the control valve have relatively little effect on the mixture proportions. The flow of catalyst into the mixing region is controlled by a valve and the extent to which the catalyst control valve is open is controlled by the position of the main control valve through a camming arrangement. When the control valve is in its first fully opened position, the catalyst valve is fully open and when the main control valve is in its fully closed, second position, the catalyst control valve is fully closed. In another embodiment of the invention which is suited for use with materials in which it may be desirable to effect a significant variation in the mixture proportions, the control valve is arranged so that between its fully open and fully closed position, there is a substantial range of intermediate positions which will enable significant variation in the relative flow rates of main resin and catalyst.

One of the important features of the invention which enables it to be used with thick, putty-like materials having a high adhesion to metal, such as those employed in automobile body shops as a body filler, relates to the configuration of the outlet nozzle for the catalyst and the shape of the flow passage which defines the mixing region. The mixing region flow passage is in the form of a convenient-divergent nozzle. The outlet end of the catalyst valve is conical and is located to project into the coverging end of the convergent-divergent nozzle. The angle defined by the catalyst outlet cone is less than that of the converging portion of the nozzle. The angles and relative locations of the catalyst cone and inlet end of the nozzle insure rapid and complete wiping of catalyst from the catalyst valve after that valve has been closed and in response to further flow of resin between the catalyst valve and the convergent-divergent nozzle.

it is among the objects of the invention to provide an improved mixer-dispenser for use with a fluent material It from a plurality of fluent components.

A further object of the invention is to provide a dispenser-mixer of the type described in which the proportions of mixed components can be controlled accurately.

A further object of the invention is to provide an improved dispenser-mixer which may be purged easily to maintain its internal passages clean and without obstruction.

A further object of the invention is to provide an improved mixer-dispenser which is capable of receiving the fluent components in and dispensing them from their original packages which results in a less messy operation.

DESCRIPTION OF THE DRAWINGS

The foregoing and other objects and advantages of the invention will be appreciated more fully from the following further description, with reference to the accompanying drawings wherein.

DESCRIPTION OF THE PREFERRED EMBODIMENT

Figure 1:
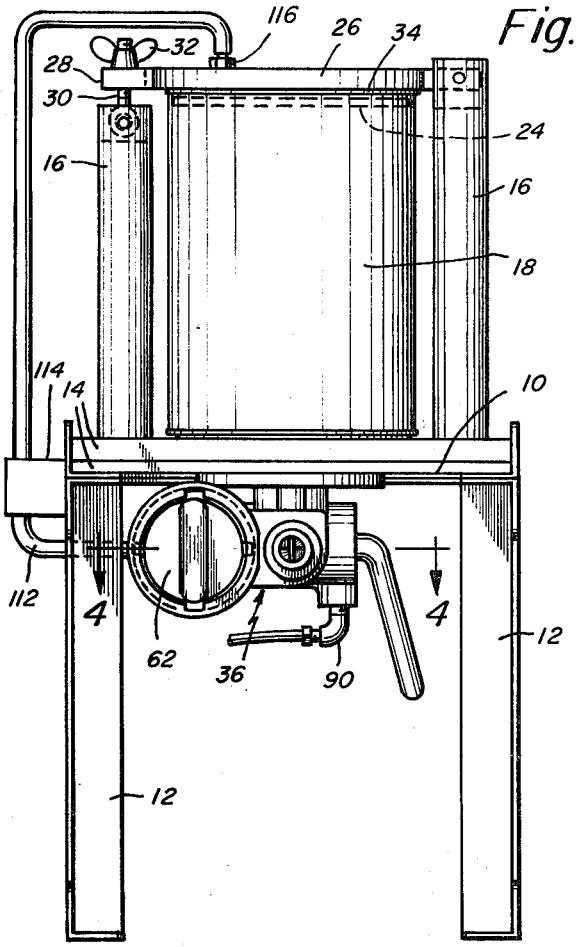
FIG. 1 is a side elevation of the device.
Figure 2:
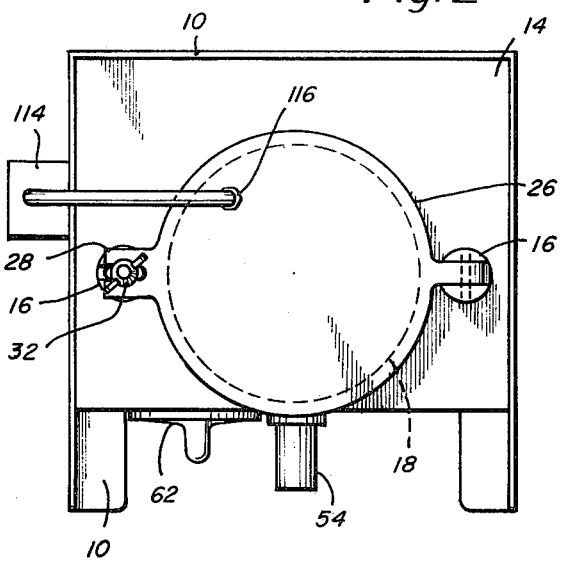
FIG. 2 is a plan view of the device.

As shown in FIGS. 1 and 2, the device may be supported by a table-like structure including a platform 10 which rests on a plurality of legs 12. A pair of support plates 14 are mounted on top of the platform 10 and a pair of spaced posts 16 are secured to and extend upwardly from the support plates 14. The resin or other primary material is intended to be placed, in its original container indicated at 18, on the support plates 14 and between the posts 16. The plates 14 have a central downwardly extending opening 20 formed therethrough. The bottom of the resin container 18 is pierced before the container 18 is placed on the plates 14 so that the opening in the bottom of the container 18 can be aligned with the opening 20 in the support plates 14. Preferably, a resilient sealing gasket 22, which also has a central hole formed therethrough, is interposed between the bottom of the container and the upper of the support plates 14. The cover is removed from the container 18 and a piston plate 24 is placed on top of the primary resin. The piston plate 24 is dimensioned and shaped so that it can be received in the container 18 and advanced downwardly, as will be described, to apply a uniform dispensing pressure to the resin in the container and to wipe the internal sides of the container 18 to insure that all of the material will be dispensed. The container is held firmly in place by a cover plate 26 hinged at one end to the upper end of one of the posts 16. The other end of the cover plate 26 has a bifurcated projection 28 which receives a bolt 30, hinged to the upper end of the otherpost 16. A wing nut 32 may be used to securely clamp the cover plate 26 to the upper rim of the container 18. A resilient gasket 34 is attached to the underside of the cover 26 to engage the rim of the container 18 in a snug, air-tight seal for the air under pressure which will be introduced into the container 18 in a manner to be described.

Secured to the underside of the platform 10 is a mixing and distribution block 36 which is machined (or otherwise formed) to define various chambers and passageways to mix and distribute the fluent product in a form ready for use. In the embodiment shown, the block 36 is attached to a lower mounting plate 38 by screws threaded into the ends of upwardly extending bosses 40 formed integrally with the block 36. The block 36 also is formed to define an upwardly extending boss 42 having a passageway 44 formed therein which communicates with and forms a continuation of the opening 20. The passageway 44 leads into a mixing bore 46 formed in the block 36. The mixing bore 46 contains a catalyst delivery tube 48 which is mounted securely at the innermost end of the bore 46 and which projects forwardly beyond the passageway 44. The mixing bore 46 and tube 48 each are circular in cross section so that the primary resin will flow along an annular flow path within the bore 46. Catalyst is introduced into the mixing bore 46 from the outermost end of the tube 48 and catalyst flow is controlled by a conical vlve indicated generally by the reference character 50. The combined resin and catalyst then flow through a convergent-divergent nozzle, indicated at 52 and then into the flow passage of a static mixer 54 where the resin and catalyst are thoroughly mixed and homogenized. In the embodiment shown, the static mixer 54 and convergent-divergent nozzle 52 are formed in a single, integral piece which is threaded securely into the outlet end of the mixing bore 46. As will be described below in further detail, the configuration of the convergent-divergent nozzle 52, valve 50 and outlet end of the catalyst delivery tube 48 is of importance in enabling the device to operate effectively with very thick, putty-like materials such as the automobile body filler compound mentioned above.

Figure 4:
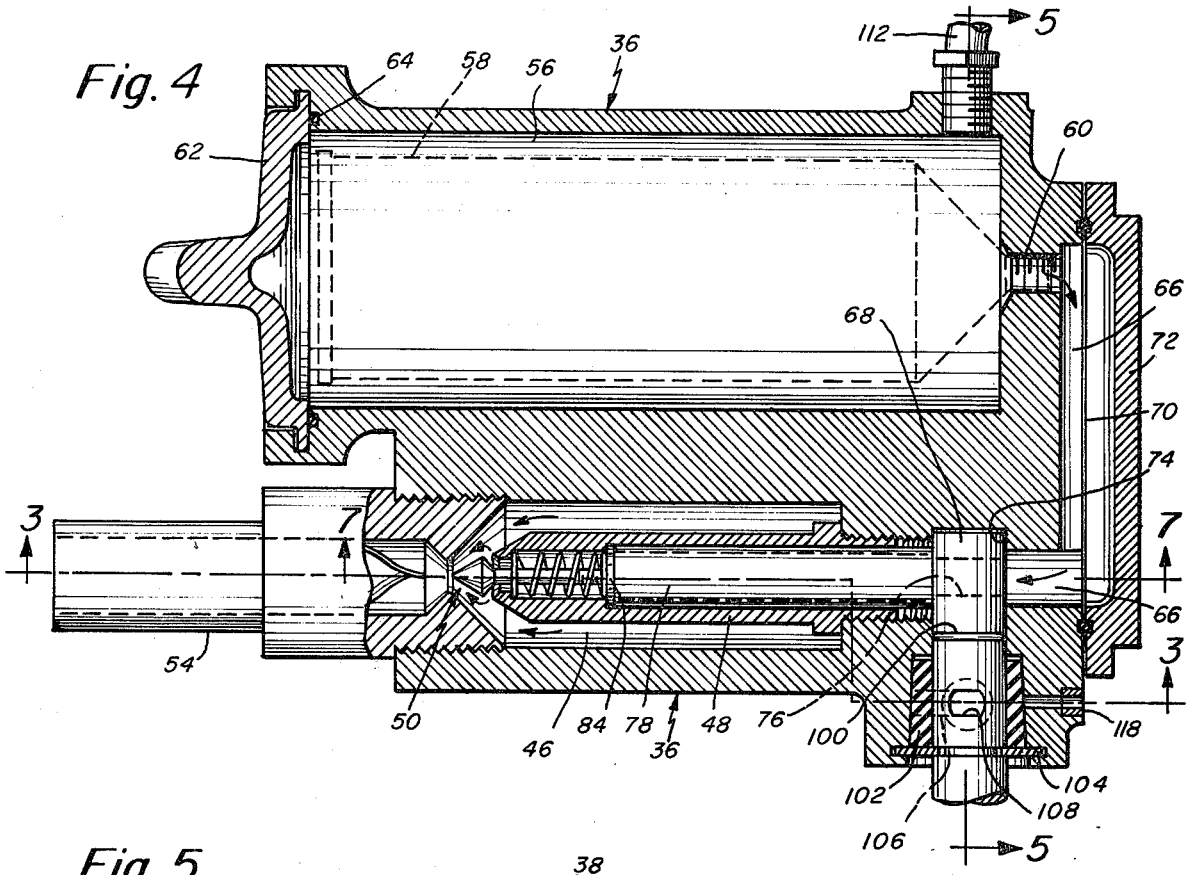
FIG. 4 is a plan section of the device as seen along the line 4—4 of FIG. 1.

The catalyst is contained in a secondary chamber 56 formed in the block 36. Often, the catalyst comes in a tube form as suggested in phantom at 58 in FIG. 4, having a threaded outlet nozzle. The secondary chamber 56 is dimensioned to receive the catalyst tube 58 in its originally packaged form and is provided at its innermost end, with a threaded bore 60 to receive and enable the threaded end of the tube 58 to be threaded directly into the rear wall of the secondary chamber 56. The front end of the chamber 56, through which the tube 58 is inserted and/or removed, can be closed by a cap 62. The cap 62 may have a bayonet type of lock as suggested in FIGS. 1 and 4 or may be threaded onto the end of the portion of the block 36 which defines the secondary chamber 56. An O-ring or other suitable air tight gasket 64 is provided to effect a good seal about the cap 62.

The outlet bore 60 leads to a flow passage 66 which communicates with a flow control valve 68. The conduit 66 preferably is defined at least in part by cooperative grooves formed on each of an end face 70 of the block 36 and an end plate 72 which is securely attached to the end face 70 of the block 36. This construction facilitates exposure of the internal passageways of the block by removing the end plate 72 should it be desired to do so for cleaning, inspection, etc.

Figure 7:
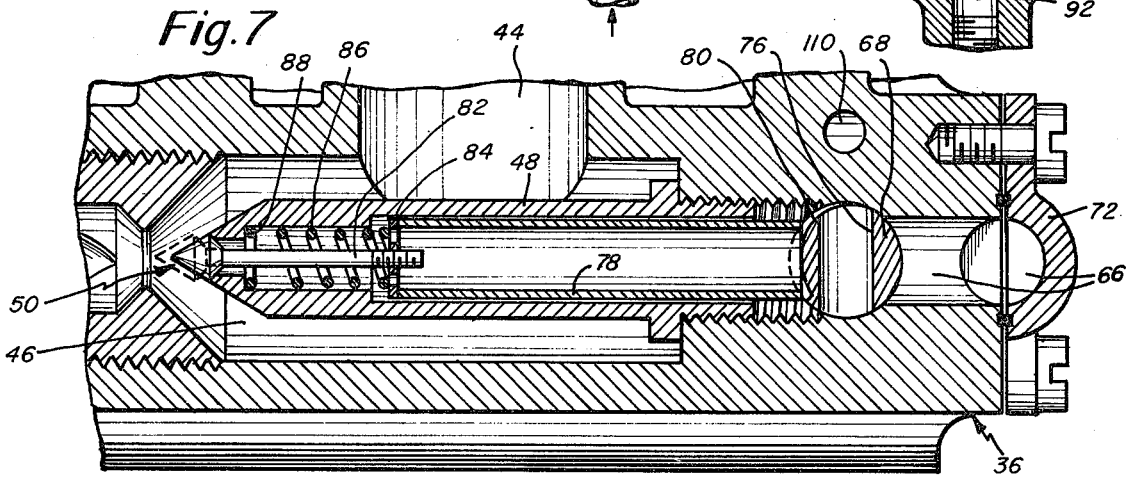
FIG. 7 is a sectional elevation of the device as seen along the line 7—7 of FIG. 4.

The flow control valve 68 is rotatable within a bore 74 which transversely intersects the flow passage 66. The valve member 68 has a bore 76 formed therethrough which opens or closes the flow passage, depending on the angular position of the valve member 68. The outlet side of the flow control valve 68 is in communication with a hollow, cylindrical valve actuator 78 which is mounted for longitudinal sliding movement within the catalyst delivery tube 48. The catalyst injection valve 50 is mounted to the front end of the valve actuator 78 and the degree to which the valve 50 is opened is a function of the longitudinal position of the actuator 78 within the tube 48. That, in turn, is controlled engagement of the rear end of the actuator 78 with a cam surface 80 formed on the outside of the control valve member 68. As shown in FIG. 7, the valve 50 is attached to the end of a stem 82 which, in turn, is attached to a perforated washer 84 located at the forward end of the valve actuator 78. A compression spring 86 surrounds the valve stem 82 and extends between a rearwardly facing shoulder 88 formed in the delivery tube 48 and the washer 84. These elements are arranged so that when the valve 68 is in its fully closed position shown in FIG. 7, the valve actuator 78 will be in its most retracted configuration, under the influence of the spring 86, and the valve 50 will be fully seated and closed (as shown in solid in FIG. 7). As the control valve 68 is rotated towards its fully open position, the cam surface 80 urges the actuator 78 along and within the tube 48 to open the valve 50. The catalyst will flow through the valve bore 76, the hollow valve actuator 78, the perforated washer 84 and out of the outlet defined by the valve 50 into the mixing chamber 46.

The foregoing arrangement is effective to control the proportion of catalyst-resin mix with a high degree of accuracy as is often required in order for the mixed product to function in its intended manner. The compression spring 86 continuously biases the valve actuator 78 into firm abutment with the cam surface 80 to insure precision in the extent to which the valve 50 is opened and that it will correspond to the position of the valve member 68. As will be described in more detail, the linear movement of the valve member 50 is relatively short in this embodiment of the invention and may be of the order of approximately 0.040 inch. The cam surface on the valve member is arranged so that the valve member 50 may be shifted between its fully open and fully closed position by rotation of the valve 68 through a relatively short arc. This insures that the mixture proportions will remain relatively constant as is desired when the proportion catalyst is relatively small (e.g. 3%).

Figure 5:
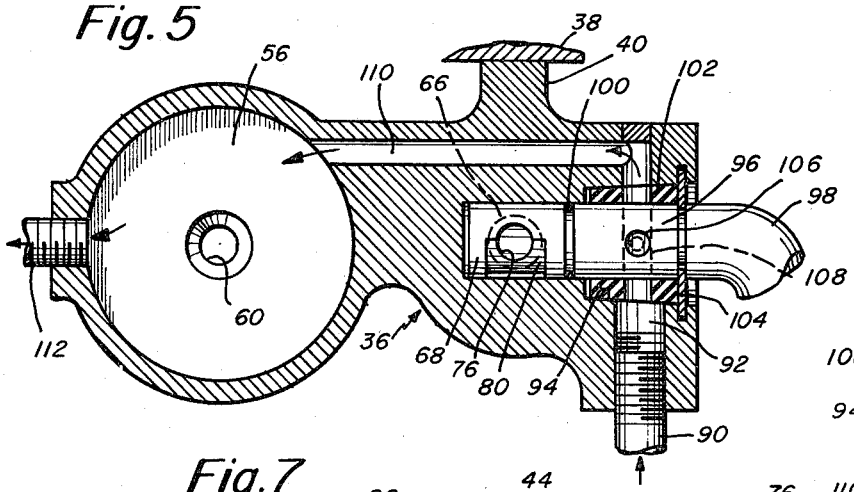
FIG. 5 is a sectional elevation of the control valve as seen along the line 5—5 of FIG. 4.

Flow of the main resin and catalyst is effected by air under pressure which is introduced into the device through an air inlet 90 (FIG. 1). Air inlet 90 is in communication with an air inlet passage 92 (FIGS. 5 and 6) formed in the block 36 and air passage 92 communicates with a tapered valve bore 94. Valve bore 94 receives a rotatable air valve member 96 which is rotatable, by a control handle 98 to permit or preclude the flow of air through the valve member 96 as will be described below. Air valve member 96 and catalyst flow valve member 68 and the control handle 98 preferably are formed from a single piece to enable simultaneous control of catalyst flow and admission of air under pressure. The air valve member 96 and catalyst valve 68 are isolated from each other by an O-ring 100 which is received in a groove which separates and defines the valve members 68, 96. The air valve member 96 is surrounded by a sealing bushing 102 which has an inwardly tapering peripheral surface. The assembly of the valve elements 68, 96, control handle 98 and sealing bushing 102 are held in place by a split ring 104 which is received in receptive grooves formed in each of the block 36 and the member 96. The ring 104 bears against the outwardly facing end of the sealing bushing 102.

Figure 3:
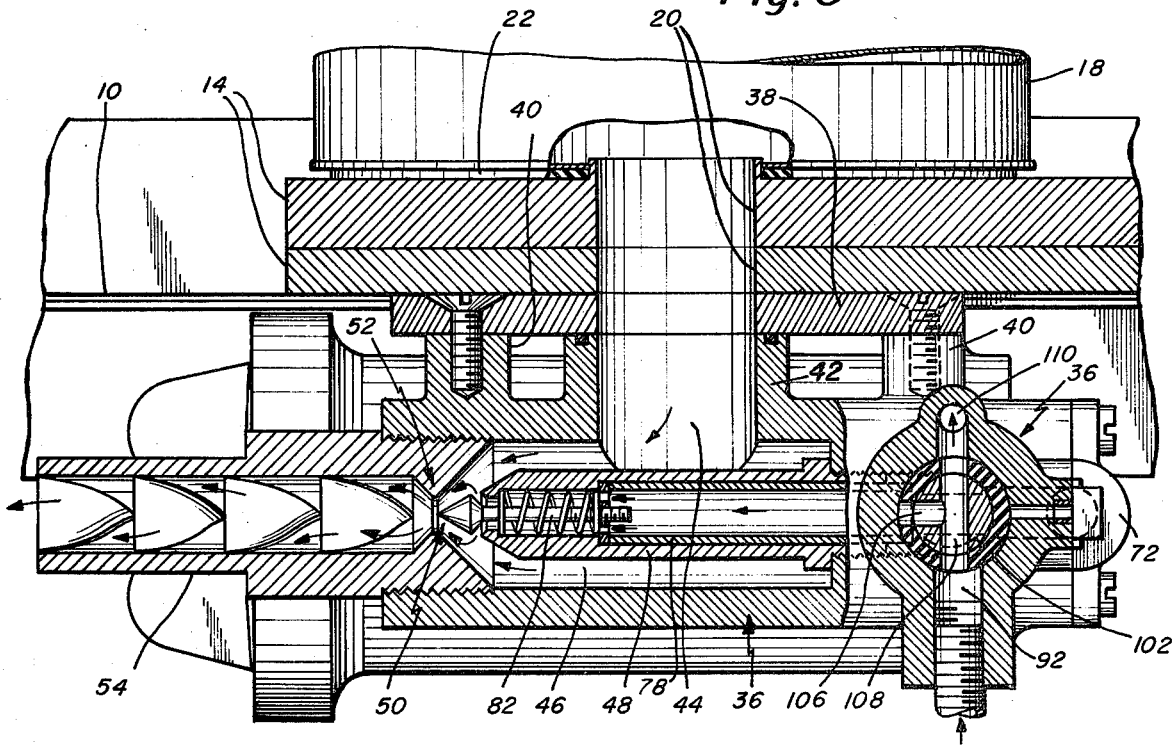
FIG. 3 is a sectional elevation of a portion of the device as seen along the line 3—3 of FIG. 1.
Figure 6:
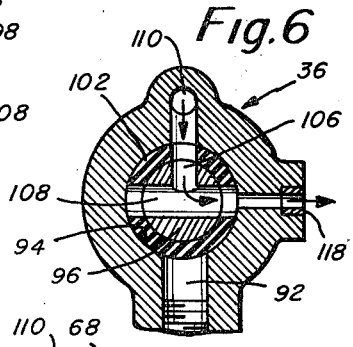
FIG. 6 is a sectional illustration of the control valve as seen in a plan similar to that of FIG. 3 and illustrating the valve in its purging and venting configuration.

The air valve member 96 has a pair of intersecting, T-shaped passages 106, 108 to enable the air valve member 96 to be rotated between the two positions shown in FIGS. 3 and 6. When in the position shown in FIG. 3, the valve passage 108 communicates the air inlet passage 92 with the secondary catalyst chamber 56 through an air passage 110 formed through the block. The air under pressure is communicated to the main resin chamber defined within the container 18 by a conduit 112, through a pressure regulator 114 and to a fitting 116 attached to the lid 26. When the air valve member 96 is rotated to its position shown in FIG. 6, the air from inlet passage 92 is cut off from the catalyst chamber 56 and container 18 and the passageway 110 is vented to the atmosphere through valve passageways 106, 108 as suggested by the arrows in FIG. 6. The device includes an air flow restrictor 118 which controls the rate at which the pressurized air is exhausted from the chamber 56 and container 18 in a manner and for purposes which will be described below.

The air valve member 96 and catalyst valve member 68 are arranged so that the catalyst flow passage 76 will be in its fully open position when the air valve member 96 is in its configuration shown in FIG. 3, and when the air valve is in the configuration shown in FIG. 6, the catalyst flow valve 68 is in its fully obstructing position shown in FIG. 7.

In the general operation of the device, the bottom of the container 18 is punctured to form a flow opening and the top of the container 18 is removed. A piston plate 24 is placed on top of the upper surface of the material in the container 18 and the lid 26 is then closed and secured in place. The cover 62 from the catalyst chamber 56 is removed and the flexible tube of catalyst material is inserted into the chamber 56 and its threaded end is screwed into the threaded bore 60 at the inner end of the chamber 56. The cap 62 then is replaced to seal the chamber 56. During loading, the control handle 98 is in its "off" position in which valve members 68 and 96 are in their positions shown in FIGS. 7 and 6, respectively. When catalyst valve member 68 is in that configuration, its cam surface 80 is such that the valve actuator 78 is fully retracted and the valve 50 is fully closed. The flow, mixing and dispensing of the materials is effected by rotating the control handle 98 to its "on" position in which the valve members 68, 96 are in the configuration shown in FIG. 3 in which catalyst flow is permitted through the valve member 68 and air is admitted to the catalyst chamber 56 and container 18 to cause flow of the resin and catalyst. Pressure regulator 114 is set so that the pressure applied to the container 18 will be less than that in the catalyst chamber 56. For example, the line pressure applied to the catalyst chamber may be of the order of 60–80 p.s.i. and the reduced pressure applied to the container 18 may be of the order of 15–20 p.s.i. These relative pressure ranges may be varied somewhat should it be desired to control the flow rates and mixture proportions of the resin and catalyst.

When the control handle 98 is rotated to its "on" position, the cam surface 80 urges the valve actuator 78 forwardly in opposition to the spring 86 to open the valve 50 at the same time that the valve passageway 76 rotates to a position which will permit catalyst flow. The pressure in the catalyst chamber 56 acts on the flexible catalyst tube 58 to cause the catalyst to flow to and through the valve 50. At the same time the pressure applied to the resin, through the piston plate 24, causes flow of the resin downwardly through the passageway 44 and along the annular resin flow passage 46 to the mixing region where the catalyst and resin mix. The preliminarily mixed catalyst and resin flow through the convergent-divergent nozzle 52 which further promotes mixing and then through the static mixer 54 where it is dispensed ready for use.

The device continues to mix and dispense the material until it is shut off by turning the control valve 98 to its "off" position. When the device is shut off, the catalyst flow valve 68 is rotated to its obstructing position (FIG. 7). The camming action of the cam surface 80 enables the compression spring 86 to urge the valve actuator 78 inwardly which, in turn, draws the valve 50 to its seated, closed position. Rotation of the handle 98 also rotates air valve 96 to its "off" position shown in FIG. 6 in which the compressed air at inlet passage 92 is blocked off from the chamber 56 and container 18 and in which the chamber 56 and container 18 are vented to the atmosphere through valve passageways 106, 108 and through the exhaust flow restrictor 118. Flow restrictor 118 presents sufficient restriction to the venting so that the pressure in the container 18 will be maintained for a sufficient time interval to continue flow of the resin from the container. It should be noted that pressure regulator 114 is selected to permit air flow from the main container 18 in a reverse direction through the chamber 56 to the flow restrictor 118. Such reverse air flow from the main container 18, however, will not begin until the pressure in the catalyst chamber 56 has dropped to a value just below that of the main container 18. Once the pressure in the chamber 56 and container 18 have been equalized, they will vent together through the passageway 110, valve member 96 and flow restrictor 118. Thus, flow of the primary resin will continue for a predetermined time interval after the catalyst outlet valve 50 has been closed. Where the pressure applied to the main resin container 18 remains substantially constant during this interval, the flow rate of resin through the system will have no significant change and will be effective to purge the portion of the system downstream of the valve 50 of all catalyst material.

The embodiment of the invention shown in FIGS. 3–7 and, particularly, the configuration of the catalyst outlet valve 50 and convergent-divergent nozzle 52 is very effective with the very viscous, putty-like materials mentioned above which are often used in automobile body filler applications. These materials typically have certain inherent properties which have not lent themselves suitable for use in an automatic mixing and dispensing device. For example, they usually must be mixed in proportions in which the mixture includes a very small proportion of catalyst (e.g. 3%). This requires extremely accurate control of the flow rate of catalyst with respect to the flow rate of the resin. Even small variations in the flow rate of the catalyst will result in a mixture batch which will not have uniform characteristics. Also, these materials frequently have a relatively brief reaction time. This requires that when the system is turned off that any catalyst remaining in contact with the resin must be purged from the system quickly and before it has a chance to harden and block the flow passages. Effective purging is further hampered by the tendency of these materials to adhere to the surfaces which define the flow passages.

Figures 8, 9, 10:
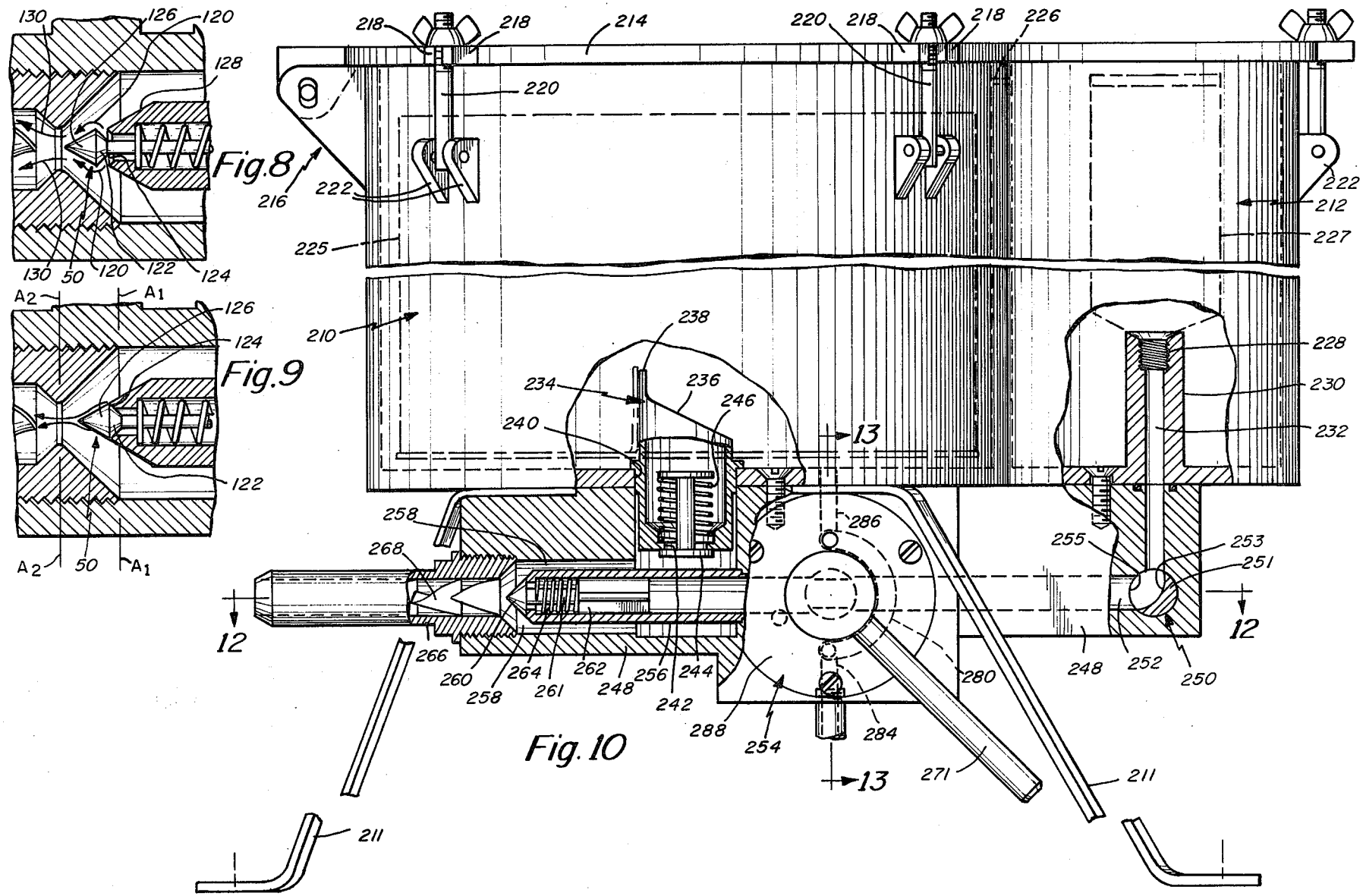
FIG. 8 is an enlarged diagrammatic illustration of the convergent-divergent nozzle when the catalyst flow valve is open.
FIG. 9 is an illustration similar to FIG. 8 with the catalyst flow valve closed.
FIG. 10 is a side elevation of another embodiment of the invention partly broken away and in section.

FIG. 8 shows the catalyst outlet valve 50, the mixing region and the convergent-divergent nozzle which results in the rapid and complete purging of catalyst from the system. The convergent-divergent nozzle and outlet end of the catalyst tube 48 are formed to insure that the flow from the valve 50 and through the nozzle will be laminar at all times and will be free from eddys or other turbulent flow patterns. As shown in enlarged FIG. 8, when the catalyst valve 50 is opened the flow from the outlet of the catalyst tube, as indicated by the arrows 120, is laminar. The rear end of the valve 50 is beveled as indicated at 122 and the valve seat 124 is similarly beveled. The flow area defined between the surfaces 122, 124 directs the ejected catalyst partly in a radially outward direction so that it will squirt clear of the rearward portions of the valve member 50 and minimize the tendency for those parts of the valve member 50 to be coated with catalyst. The catalyst is ejected into the mixing region and merges in smooth laminar flow with the primary resin. The valve member 50 preferably is formed from a relatively hard rubber material and its beveled surface 122 and the valve seat 124 are formed with a high degree of precision to insure that when the member 50 is withdrawn to its fully closed position, the seating of the valve 50 will be complete and the exterior conical surface 126 will merge smoothly and be flush with the tapered surface at the outlet end of the catalyst tube 48.

As the resin and catalyst continue to flow toward the waist of the nozzle, the laminar flow condition is maintained and the velocity of the flowing mixture increases progressively. As will be described below in more detail, the angle of the cone defined by the valve 50 is less than that defined by the converging side of the nozzle which presents a progressively reduced flow area with an attendant increase in flow velocity. The velocity of the mixture is at its highest through the waist of the nozzle and the flow through the nozzle is substantially laminar. As the resin and catalyst flow into the divergent side of the nozzle, the velocity decreases and there is a radial expansion of the resin and catalyst as suggested by the arrows 130 in FIG. 8. This tends to distribute the catalyst more evenly throughout the mixture while still maintaining laminar flow. The mixture then passes through the static mixer where it is homogenized and thoroughly mixed to its ready-to-use state and is then dispensed from the outlet end of the static mixer. The invention employs a technique in which the catalyst is injected into the flow of primary resin centrally along the flow passage. The catalyst tends to be carried along with the stream of primary resin within the core of resin and does not contact the internal walls of the flow passage, at least until the mixture reaches the static mixer. This remains true even in the divergent side of the convergent-divergent nozzle where the reduced pressure and expansion tend to cause the catalyst to become more widely dispersed in the mixture. There remains, at all times, a thin boundary layer of primary resin along the internal surface of the mixture bore which acts as a protective sleeve surrounding the resin/catalyst mixture. This protective sleeve-like boundary layer further minimizes the chance of catalyst contacting the internal surfaces of the bore and facilitates purging.

FIG. 9 shows the valve 50 in its fully closed position. In the event that the more forward regions of the valve 50 became coated with catalyst, that coating is effectively wiped off by the still flowing primary resin. Moreover, the velocity of the resin through the converging side of the nozzle increase progressively because of the progressive reduction in flow area. This enhances and promotes rapid wiping of the catalyst from the tip. The flow remains laminar and is substantially free of turbulence which might bring some of the catalyst contact with other internal surfaces of these flow passages. With the present invention, the internal surfaces are wiped free of catalyst very rapidly and it is not necessary to continue flow of main catalyst for a long time period with the result of waste of material as well as inconvenience.

I have found that the angles defined by each of the convergent and divergent sides of the nozzles preferably should be equal and of the order of 45°. The valve seat 124 preferably is disposed just inwardly of the beginning of the convergent side of the nozzle. The angle defined by the conical surfaces 126 and 128 should be somewhat less than the angle defined by the convergent side of the nozzle and maybe, for example, of the order of 30°. The delivery tube 48 and the valve 50 preferably are arranged so that when the valve 50 is fully opened (approximately 0.040 inch linear travel), the apex of the valve member 50 will be disposed in proximity to the waist of the nozzle and on its inlet side.

It also should be noted that because of the nature of the putty-like resin and catalyst mixture, the catalyst has a tendency to pull out in taffy-like strings when valve 50 is shut, as suggested somewhat in phantom in FIG. 9. In the absence of the nozzle and valve configuration described above, continued purging progressively reduce the diameter of the taffy-like string, but does not remove it completely until a very substantial amount of resin has flown past the valve 50. By way of example, I have found from experimentation that in order to purge without the above configuration, the volume flow of resin must be well over five times the amount of mixture which is to be purged. With my invention, substantially less volume of resin is required for purging. I have also found that with the automobile body filler type of material, purging performance is enhanced when the cross-sectional areas in the valve and nozzle region are within certain ratio limits. For example, I have found that the ratio of cross sectional flow areas $A_1/A_2$ (FIG. 9) should be of the order of 1/10 for optimum results in purging and to achieve laminar flow.

The foregoing embodiment of the invention is useful particularly with the thick, putty-like materials described. FIGS. 10–16 show another related system for mixing and dispensing fluent materials which do not present the difficulties described above, or at least do not present them to the same degree.

This embodiment includes a first main chamber 210 and a secondary chamber 212. The entire device may be mounted on legs 211 which are secured to he underside of the chambers. Both chambers have an open top which can be sealed simultaneously by a removable cover 214. The cover 214 may be hinged to the wall of one of the chambers as suggested generally at 216 and may be provided with a plurality of lugs 218 at spaced locations along its periphery to enable the cover 214 to be firmly secured to the upper edge of the chambers 210, 212 as by bolts 220. The bolts 220 may be hinged to trunions 222, located on the exterior of the chambers 210, 212. The cover 214 and upper edge of the main chamber 210 and secondary chamber 212 are designed so that they can fit in an airtight seal to enable the chambers 210, 212 to be pressurized. The main chamber 210 and secondary chamber 212 have a common generally tangential wall 224 and a small air bleed hole 226 extends through the wall 224 to enable the pressure in each of the chambers 210, 212 to be maintained at the same level.

Main chamber 210 is designed to receive a can or other suitable container 225 for one of the components to be mixed, such as the resin of an epoxy formulation. The secondary chamber 212 is intended to receive a second fluent component such as a tube of catalyst which will serve as a hardener when mixed with the resin. Each of the chambers 210, 212 is intended to receive the fluent component in its original package. For example, where the catalyst is in the form of a collapsible tube 227 having a threaded outlet as suggested at 228 in FIG. 10, the bottom of the chamber 212 may have an upstanding tubular member 230 having internal threads at its upper end to enable the threaded end 228 of the tube to be screwed into the member 230. The member 230 defines the beginning of an interior passageway 232 which directs the hardener to a mixing region as will be later described.

The resin component similarly is inserted into the main chamber 210 in its original package 225 which typically may be made from metal. The cover of the resin package first is removed or punctured. A piercing spout indicated generally at 234 is located at the bottom of the main chamber so that when the resin container 225 is placed in the main chamber 210, the spout will pierce the bottom wall of the container to enable the resin to flow from the container through the spout to the mixing region. The piercing spout 234 is generally tubular having an oblique edge 236 and an upwardly extending, relatively sharp piercing point 238. The piercing spout 234 is secured to the bottom wall of the main chamber 210 and its lower end extends downwardly through a hole 240 in the bottom wall. The lower end of the piercing spout 234 includes an outlet orifice 242 which is normally closed by means of a valve member 244 and spring 246 which biases the valve member 244 upwardly to its closed position.

The outlet passageway 232 leading from the secondary chamber 212 and the outlet orifice 242 leading from the main chamber 210 each are in communication with continuing passages formed within a conduit block 248 which may be formed integrally with or secured to the underside of the main chamber. As shown in FIG. 10, passageway 232 continues into the block 248 and leads to a mixture valve 250 by which the rate of flow of catalyst can be controlled. The outlet side of the mixture valve 250 communicates with a conduit 252 formed through the block 248 which, in turn, leads to a control valve indicated generally at 254 which is employed to permit or preclude flow of the catalyst therethrough. The outlet end of the control valve 254 communicates with a tube 256 which is secured to and within the block 248. Outlet orifice 242 from main chamber 210 also is in communication with the mixing passage 258 when valve 244 is open. The outlet end of the tube 256 normally is closed by a valve member 260. The valve member 260 includes a threaded valve stem 261 which is secured to a fluted plug 262. A passageway is defined between the flutes in the plug 262 and the inner cylindrical wall of the tube 256 to enable the catalyst to flow from the control valve 254 to and through the outlet valve 260 when valve 260 is open as will be described.

In a normal mixing and dispensing mode, air under pressure is communicated to each of the chambers 210, 212 and is applied to the respective fluent components. With the valve 250 and 254 open, catalyst will flow from tube 227 through the passages 232, 252 through the valve 254, the tube 256 and out the open valve 260. The valve 260 is maintained open in response to the pressure of the fluent catalyst within the outlet tube 256. At the same time, the pressure applied to the resin in the main chamber 210 causes it to flow downwardly through the piercing spout 234 which causes valve 244 to open. The resin flows into the mixing passage 258 along and outside the tube 256 and mixes with the catalyst at the outlet end of the tube 256. Downstream of the outlet tube 256 is a dispensing nozzle 266 which has a static mixing device 268 disposed therein to fully and thoroughly homogenize the resin and catalyst.

Mixture control valve 250 includes a rotatable valve member 251 which is generally cylindrical except for a cut-away region 253. The generally cylindrical valve member 251 is contained within a cylindrical bore 255 and may be rotated by an external control knob 257 which is secured to the valve body 251. The valve member is rotated to position the cut-away portion 253 with respect to the flow passage 232 in a manner to variably restrict the flow passage and thus control the flow rate of the catalyst for any given pressure within the secondary chamber 212.

It may be desirable, when beginning flow, to delay the introduction of catalyst into the mixing passage 258 until slightly after the resin is introduced and, conversely, when stopping flow it is desirable to terminate catalyst flow from the outlet valve 260 just slightly before the flow of resin stops. To this end, springs 246, 264 are selected to insure that valve 260 will only be open when a sufficient pressure in the system has been reached, which pressure level is greater than that required to open valve 244.

Figures 11, 12, 13, 14, 15, 16:
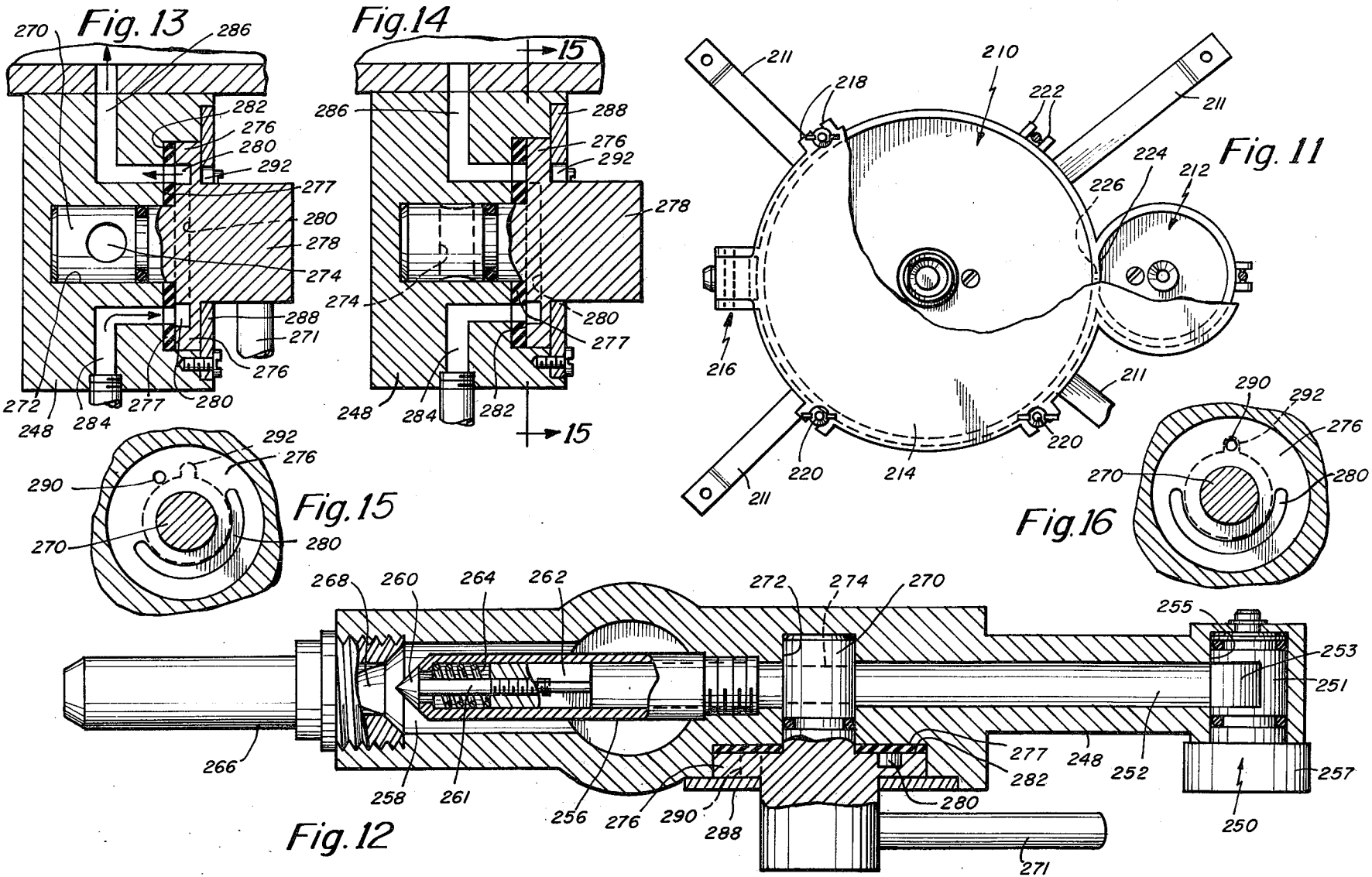
FIG. 11 is a plan view of the embodiment shown in FIG. 8 with the cover partly broken away.
FIG. 12 is a sectional elevation of the dispensing and mixing passages of the embodiment shown in FIG. 8 as seen along the line 12—12 of FIG. 10.
FIG. 13 is a sectional illustration of the control valve as seen along the line 13—13 of FIG. 10 when the valve is in the fully opened position.
FIG. 14 is an illustration of the control valve similar to FIG. 13 illustrating its position to block communication of air to the chambers to preclude catalyst flow.
FIG. 15 is an illustration of the control valve collar when in the position shown in FiG. 14 as seen along the line 15—15 of FIG. 14.
FIG. 16 is an illustration of the control valve collar similar to FIG. 15 illustrating its position when venting the chamber directly to the atmosphere.

The resin and catalyst are caused to flow by air pressure which is introduced into the device through the control valve mechanism 254. Control valve 254 thus is a multi-function valve in that it controls both the introduction of air into the system as well as the flow of the fluent components to the mixing region 258. As shown in FIGS. 12–14, the control valve 254 includes a cylindrical valve body 270 rotatable within a transverse hole 272 in the block 248. A flow passage 274 is formed in the valve body 270 at a location such that when the axis of the flow passage 274 is in alignment with the axis of the flow passage 252 in the block, it will permit the catalyst to flow from the second chamber 212 toward the mixing passage 258.

The valve 254 also controls the admission of air under pressure to the chambers 210, 212. To this end, the valve includes an enlarged collar 276 between the knob end 278 and the valve body 270. The collar has a semicircular groove 280 at its inwardly facing surface 282. The portion of the block 248 which houses the control valve 254 includes an air inlet passage 284 and an air outlet passage 286. The air inlet passage 284 is connected to a suitable source of pressurized air (not shown). The air outlet passage 286 is in communication with the main chamber 210, for example, by an opening in the bottom wall of the main chamber 210. The arcuate groove 280 serves to connect or disconnect the inlet and outlet passages 284, 286 depending on the position of the valve. Thus, in the configuration shown in FIGS. 14 and 15, the valve body 270 is in a position in which the flow passage 274 is not in alignment with flow passage 252, thus shutting off flow of the catalyst. At the same time, semicircular groove 280 is not in communication with the outlet passage 286 thus isolating the pressure source from the chambers 210, 212. The control valve is retained in the valve housing by an annular retaining plate 288 which is fastened to the body 248. If desired, an appropriate gasket 277 having openings corresponding to those formed in the body 248 may be interposed between the collar 276 and the body 248 to effect a sufficient seal therebetween.

In operation the resin and catalyst container 225, 227 are each placed in their respective chambers 210, 212 with the piercing spout 234 extending into the bottom of the resin container 225. The catalyst, which in the embodiment shown is contained in a compressible, collapsible tube 227 having a threaded neck 228 is screwed into the upper end of the tubular member 230 within the secondary chamber 212. The lid 214 then is shut and is securely clamped to seal the chambers 210, 212. Mixture control valve 250 may be set at this time to open the flow passage therethrough to the desired extent which will control the flow rate of the fluent catalyst. During loading, the control valve 254 preferably is in the closed configuration shown in FIG. 14 in which flow of catalyst is blocked. Additionally, when in this configuration, air outlet passage 286 is out of registry with the semi-circular connective groove 280 thus maintaining the chambers 210, 212 in an unpressurized condition. After the chambers 210, 212 have been loaded and the lid is securely clamped, the valve 254 then is rotated to an operative position (as by handle 271) in which hole 274 of valve body 270 will permit flow of catalyst through the valve 254 and also to register the ends of the semi-circular groove 280 with both the inlet and outlet passages 284, 286 as suggested in FIG. 13. As the pressure in chambers 210, 212 increases, the resin and catalyst each begin to flow, the resin flowing downwardly through the spout 234 and the catalyst through the passageway 232. The main chamber 210 and secondary chamber 212 are at the same pressure and this is achieved by bleed hole 226 through common wall 224 by which the pressure in the secondary chamber 212 is maintained equal to that in the main chamber 210. As the pressure builds up in the main chamber, the resin flows downwardly through the spout 234 and opens valve 244 to enable the resin to flow to the mixing region 258 about the tube 256. The resin flows toward the outlet nozzle 266. At the same time, the pressure within the secondary chamber 212 causes the catalyst to flow, at a rate determined by the setting of metering valve 250 through passageways 232, 252, through the open valve 254 and into the tube 256. The catalyst flow is delayed slightly by the bleed hole 226 until pressure in chamber 212 has reached a sufficient predetermined level. When the predetermined level is reached, the pressure of the catalyst against the rear end of the slidable fluted plug 262 urges the plug forwardly, overcoming the resistance of the spring 264 and thus opening valve member 260 to enable the catalyst to flow into the downstream end of the mixing passage 258 where the catalyst mixes with the resin. As described, the effective force of spring 264 is greater than that of spring 246 thus further insuring that the valve 260 will not open until after valve 244 has opened and the resin has flowed into the downstream region of the mixing passage 258. As long as control valve 254 is mantained in this open configuration the resin and catalyst thereafter will each continue to flow and mix and will be further mixed in the static mixer 268 from which the mixed material may be dispensed as desired.

This embodiment achieves one of its main objects of effective purging of the system after use, by operation of the control valve 254. When it is desired to shut down the device, the control valve 254 is moved to its closed position (FIG. 14) in which flow of catalyst is precluded and also in which the source of air pressure is cut off from the chambers 210, 212. As soon as the valve body 270 blocks further flow of catalyst into the tube 256, the spring 264 urges the valve member 260 to a closed position to shut off further entry of catalyst into the mixing passageway 258. The resin, however, continues to flow under the influence of the residual pressure within the main chamber 210 until the pressure in the chambers is insufficient to maintain valve 244 open, at which time valve 244 closes. The spring 246, however, preferably is of a strength such that valve 244 will close when the pressure in the chambers is just slightly above atmospheric. Thus, when control valve 254 is shifted to its closed position, the resin will continue to flow after catalyst flow has terminated. This draws away the remaining residual catalyst from the system so that after the pressure in the chamber has dropped to its lowest static level, there will be no remaining mixture of resin and catalyst within the pressageways of the device. As a result, the passageways and static mixing device will not become obstructed by a hardened mixture. It may be noted that in this embodiment, the entry to the static mixer does not include the convergent-divergent nozzle. The use of such a nozzle has been found particularly advantageous with those materials in which the catalyst tends to draw out in a taffy-like string. Where the materials are not as thick and display less of a tendency to adhere to the internal surfaces of the passage-ways, the convergent-divergent nozzle may be omitted.

An alternative mode of operation to purge the system might also be to shut off mixture valve 250 to totally preclude flow of catalyst and then maintain the control valve 254 in an open configuration for a short period of time. In this mode of operation, the resin would continue to flow for a longer period of time under the influence of the continually admitted pressurized air. After the device has been sufficiently purged, the control valve 254 may then be switched to its completely closed position thus shutting off the air supply and enabling a further automatic purge under the influence of the residual pressure as described above. In this mode of operation, valve member 260 would also close when valve 250 is closed.

In some instances, it may be desirable to provide means for rapidly venting the chambers to the atmosphere. For this purpose, the collar on the control valve 254 may be provided with a through hole 290 at a location which will enable the hole 290 to be registered with the air outlet passage 286 while maintaining the catalyst flow passage blocked off. A cutout 292 may be formed in the valve retaining plate 288 to permit the air to exhaust from the chambers and through the vent hole 290 when outlet passage 286 and cutout 288 are in communication as the result of hole 290 having been advanced into registry therewith. This is further suggested in FIG. 16.

It should be understood that the foregoing description of the invention and its various embodiments is intended merely to be illustrative thereof and that other modifications and embodiments may be apparent to those skilled in the art without departing from the spirit.

Having thus described the invention, what I desire to claim and secure by Letters Patent is:

1. An apparatus for mixing a plurality of fluent components and for dispensing them in a mixed condition comprising:

at least two sealable chambers for receiving each of the fluent components;

a first conduit extending from one of the chambers to a dispensing outlet;

a second conduit extending from another of the chambers, the second conduit terminating in communication with the first conduit at a location between the ends of the first conduit;

means for introducing air under pressure to each of the chambers to induce flow of the fluent components through the conduits;

control valve means disposed along the second conduit for precluding or permitting flow of the fluent component through the second conduit and for simultaneously precluding or permitting communication of air under pressure from a source thereof to the chambers; and flow valve means at the outlet end of the second conduit and being responsive to operation of the control valve means for opening and closing the outlet end of the second conduit, whereby upon operation of the control valve means to terminate flow in the second conduit and preclude communication of pressurized air to the chambers, the residual pressurized air in at least one of the chambers may cause continued flow of the fluent component in that chamber to thereby purge the first conduit of the mixed fluent components.

2. An apparatus as defined in claim 1 further comprising:

said control valve means including cam means operable simultaneously with operation of the control valve means;

an actuating member connected between the cam means and the flow valve means for opening and closing the flow valve means in response to operation of the control valve means.

3. An apparatus as defined in claim 2 wherein the actuating member further comprises:

a tube movable longitudinally within the first conduit, said tube having an upstream end in engagement with the cam means and a downstream end in engagement with the flow valve means; and means for biasing the tube downstream into firm continual engagement with the cam means.

4. An apparatus as defined in claim 1 further comprising:

said first conduit having a convergent-divergent nozzle therein, the flow valve means being disposed within and movable within the convergent side of the nozzle;

said flow valve being tapered in a downstream direction and terminating in an apex;

the taper of the flow valve means being less than the taper of the convergent side of the nozzle thereby to present a progressively reduced cross sectional flow area from the inlet side of the convergent portion of the nozzle to the waist of the nozzle.

5. An apparatus as defined in claim 4 further comprising:

a static mixer disposed downstream of the convergent divergent nozzle.

6. An apparatus as defined in claim 4 further comprising:

the flow valve means and nozzle being arranged so that when the flow valve means is open, its apex will be disposed in proximity to the waist of the nozzle.

7. An apparatus as defined in claim 1 further comprising:

said sealable chambers including a first chamber communicating with the first conduit and a second chamber communicating with the second conduit;

means for maintaining the first chamber at a different pressure than that of the second chamber.

8. An apparatus as defined in claim 7 further comprising:

means maintaining the pressure in the first chamber at a lower level than that in the second chamber at least during the interval when the control valve means permits communication of air under pressure to the chambers.

9. An apparatus as defined in claim 8 further comprising:

means responsive to operation of the control valve means to preclude air flow for venting air from the first chamber at a predetermined rate to control the duration of said continued flow of fluent component.

10. An apparatus as defined in claim 9 wherein the means for introducing air under pressure to each of the chambers further comprises:

means for communicating air under pressure to the second chamber;

an air conduit communicating the second chamber with the first chamber;

a one-way pressure regulator for reducing the pressure of the air directed from the second chamber to the first chamber, whereby when the first chamber is vented the air at the higher pressure in the second chamber will maintain the pressure in the first chamber at a constant level until the air pressure in the second chamber falls to said constant level.

11. An apparatus as defined in claim 1 further comprising:

said flow valve means being responsive to the pressure of the fluent component in the second conduit, said flow valve means being operative to close in response to termination of flow through said second conduit.

12. An apparatus as defined in claim 11 further comprising:

mixture control valve means disposed in the second conduit between the chamber associated with the second conduit and said control valve means.

13. An apparatus as defined in claim 11 further comprising:

means for venting at least one selected of the chambers directly to the atmosphere.

14. An apparatus as defined in claim 13 further comprising:

said control valve means having a third position in which flow through the second conduit is precluded and in which said selected chamber is simultaneously vented to the atmosphere.

15. An apparatus as defined in claim 11 wherein said flow valve means comprises first pressure responsive valve means, said apparatus further comprising:

second pressure responsive valve means for precluding flow into the first conduit from its associated chamber when the pressure in said associated chamber falls below a predetermined level, the first and second pressure responsive valve means being constructed and arranged so that the first pressure responsive valve means will close before said second pressure responsive valve means closes.

16. An apparatus as defined in claim 11 wherein said flow valve means comprises:

a member slideable within said second conduit and being of cross-sectional configuration to permit flow of fluent material past said member;

a stem extending from said member toward the outlet of the second conduit;

a valve member connected to the stem; and bias means for urging the member away from the outlet of the second conduit.

17. An apparatus as defined in claim 11 wherein said control valve means comprises:

a housing, the second conduit extending through the housing;

an air passage formed in the housing having an inlet port for connection to an air source and an outlet port in communication with one of the chambers;

a common valve member having one portion in the second conduit and another portion extending between the air inlet and the air outlet, said valve portions being movable in unison;

a flow passage formed in the first portion of the valve member to selectively permit or preclude flow through the second conduit;

a flow passage formed in the other portion of the valve member to selectively permit or preclude air flow therethrough;

said air flow passages being disposed to selectively permit or preclude simultaneous flow of fluent material and air flow.

18. An apparatus as defined in claim 17 further comprising:

means defining the vent flow passage in the second portion of said common valve member at a location to enable the vent passage to be moved into registry with said air outlet passage for communicating said chamber directly to the atmosphere.

19. An apparatus as defined in claim 11 further comprising:

means in each chamber for receiving a fluent component in an original package.

20. An apparatus as defined in claim 19 further comprising:

one of said original packages being puncturable, said chamber for receiving said package including means for causing the package to be punctured in response to insertion of the package into the chamber.

21. An apparatus as defined in claim 11 further comprising:

means for maintaining both of said chambers at the same pressure.

* * * * *